US009258657B2

(12) United States Patent
Jensen et al.

(10) Patent No.: US 9,258,657 B2
(45) Date of Patent: Feb. 9, 2016

(54) METHOD OF MANUFACTURING A SOFT CUSTOM EAR MOLD AND A SOFT CUSTOM EAR MOLD

(71) Applicant: Widex A/S, Lynge (DK)

(72) Inventors: Peter Nordland Jensen, Kastrup (DK); Klaus Henrik Vaarbroe, Skovlunde (DK); Nikolaj Hommelhoff Jensen, Copenhagen (DK)

(73) Assignee: Widex A/S, Lynge (DK)

( * ) Notice: Subject to any disclaimer, the term of this patent is extended or adjusted under 35 U.S.C. 154(b) by 0 days.

(21) Appl. No.: 14/221,911

(22) Filed: Mar. 21, 2014

(65) Prior Publication Data

US 2014/0205124 A1 Jul. 24, 2014

Related U.S. Application Data

(63) Continuation-in-part of application No. PCT/EP2011/068011, filed on Oct. 14, 2011.

(51) Int. Cl.
*H04R 25/00* (2006.01)
*H04R 1/10* (2006.01)

(52) U.S. Cl.
CPC ..... *H04R 25/652* (2013.01); *H04R 25/608* (2013.01); *H04R 25/658* (2013.01); *H04R 1/1058* (2013.01); *H04R 25/654* (2013.01); *H04R 2460/17* (2013.01); *Y10T 29/49826* (2015.01)

(58) Field of Classification Search
CPC .. H04R 25/652; H04R 25/658; H04R 25/608; H04R 25/654
See application file for complete search history.

(56) References Cited

U.S. PATENT DOCUMENTS

| | | | | |
|---|---|---|---|---|
| 3,157,245 | A | 11/1964 | Bernstein | |
| 5,487,012 | A | 1/1996 | Topholm et al. | |
| 5,488,205 | A | 1/1996 | Major | |
| 6,795,562 | B1 | 9/2004 | Gunnersen et al. | |
| 2008/0101637 | A1* | 5/2008 | Ho | H04R 25/00 381/328 |
| 2008/0116003 | A1* | 5/2008 | Suyama | 181/135 |
| 2009/0041261 | A1 | 2/2009 | Fickweiler et al. | |

FOREIGN PATENT DOCUMENTS

| | | | |
|---|---|---|---|
| WO | 99/07182 | A2 | 2/1999 |
| WO | 2010/040351 | A1 | 4/2010 |

OTHER PUBLICATIONS

International Search Report for PCT/EP2011/068011 dated Jul. 3, 2012.

(Continued)

*Primary Examiner* — Tuan D Nguyen
(74) *Attorney, Agent, or Firm* — Sughrue Mion, PLLC

(57) ABSTRACT

A soft custom ear mold (300) comprising: an inner ear mold part (100) consisting of a first bushing (101), a sound tube (102) and an ear wax guard bushing (103), and an outer ear mold part (200) that is adapted to fit an individual ear canal and comprises a sound conduit having holding means adapted to engage said inner part (100). The holding means defines the correct positioning of said inner part (100) in the sound conduit of said outer part (200) whereby a precise and stable positioning of the ear wax guard bushing (103) in the soft custom ear mold (300) is provided. The invention also relates to a hearing aid comprising such an ear mold (300, 900), a method for manufacturing such an ear mold and a tool for carrying out a part of said manufacturing method.

17 Claims, 3 Drawing Sheets

(56) References Cited

OTHER PUBLICATIONS

PCT International Preliminary Report on Patentability for PCT/EP2011/068011 Nov. 18, 2013.

Myron H. Raas et al, Earmold Modification Techniques, Hearing Instruments, Harcourt Brace Jovanovich Publ, Duluth , Minnesota, US, vol. 41, No. 1, Jan. 1, 1990, pp. 20, 22-23, XP000137483.

* cited by examiner

METHOD OF MANUFACTURING A SOFT CUSTOM EAR MOLD AND A SOFT CUSTOM EAR MOLD

CROSS REFERENCE TO RELATED APPLICATIONS

The present application is a continuation-in-part of International application No. PCT/EP2011/068011, filed on Oct. 14, 2011, published as WO-A1-2013053402, and incorporated by reference herein in its entirety.

BACKGROUND OF THE INVENTION

1. Field of the Invention

The present invention relates to hearing aids. The invention, more specifically, relates to a soft custom ear mold for hearing aids. The invention further relates to a method of manufacturing a soft custom ear mold. The invention, in particular, relates to a tool for use in the method.

In the context of the present disclosure, a hearing aid should be understood as a small, battery-powered, microelectronic device designed to be worn behind or in the human ear by a hearing-impaired user. Prior to use, the hearing aid is adjusted by a hearing aid fitter according to a prescription. The prescription is based on a hearing test, resulting in a so-called audiogram, of the performance of the hearing-impaired user's unaided hearing. The prescription is developed to reach a setting where the hearing aid will alleviate a hearing loss by amplifying sound at frequencies in those parts of the audible frequency range where the user suffers a hearing deficit. A hearing aid comprises one or more microphones, a battery, a microelectronic circuit comprising a signal processor, and an acoustic output transducer. The signal processor is preferably a digital signal processor. The hearing aid is enclosed in a casing suitable for fitting behind or in a human ear.

As the name suggests, Behind-The-Ear (BTE) hearing aids are worn behind the ear. To be more precise an electronics unit comprising a housing containing the major electronics parts thereof is worn behind the ear. An ear mold for emitting sound to the hearing aid user is worn in the ear, e.g. in the concha or the ear canal. In a traditional BTE hearing aid, a sound tube is used because the output transducer, which in hearing aid terminology is normally referred to as the receiver, is located in the housing of the electronics unit. In some modern types of hearing aids a conducting member comprising electrical conductors is used, because the receiver is placed in the earpiece in the ear. Such hearing aids are commonly referred to as Receiver-In-The-Ear (RITE) hearing aids. In a specific type of RITE hearing aids the receiver is placed inside the ear canal. This is known as Receiver-In-Canal (RIC) hearing aids.

2. Prior Art

Basically two different types of ear molds are offered today. The first type may be denoted custom ear molds and are characterized in that the shape of a specific ear canal is obtained and that the ear mold is subsequently manufactured such that it corresponds to the specific ear canal. At present the shape of the ear canal is typically obtained using an ear impression but this need not be the case since e.g. various digital scanning methods can also provide the shape of a specific ear canal. The second type may be denoted instant fit ear molds and are characterized in that they have not been adapted to the shape of a specific ear canal. Instead this type of ear molds has been adapted to cover a wide range of ear canals. Generally the custom ear molds are advantageous compared to the instant fit type in that they provide a secure and precise fit in the ear canal, whereby the ear molds will not tend to fall out of the ear, and the leakage of sound around the ear mold will be small whereby the risk of acoustic feedback is reduced.

The respective custom and instant-fit ear molds may further be sub-divided into soft and hard ear molds. The hard custom ear molds may e.g. be manufactured using rapid prototyping techniques. Further details concerning such a method can be found e.g. in U.S. Pat. No. 5,487,012.

Generally the hard ear molds are advantageous in that the hard materials provide high acoustic attenuation. This is important in order to control sound leakage, and hereby acoustical feedback, from an interior sound channel in the ear mold and towards the surroundings outside the ear mold. The hard ear molds may be disadvantageous in that the hearing aid fitter will typically have to send the ear canal impressions to a remote ear mold manufacturing site, which has the consequence that the hearing aid user has to wait a few days before he can obtain his new hearing aid with hard custom ear molds.

The soft custom ear molds are typically manufactured by a hearing fitter, who obtains an impression of a specific ear canal and uses a negative of the impression to mold a soft ear mold in e.g. silicone. The soft custom ear molds are advantageous in that they may provide an improved comfort relative to hard ear molds, in that they may reduce sound leakage—even compared to hard custom ear molds, and in that local hearing aid fitters can manufacture this type of ear mold in-house. The soft ear molds may be disadvantageous in that the acoustic attenuation of the available soft ear mold materials is low compared to the available hard ear mold materials.

As already disclosed the soft ear mold is preferably manufactured in silicone. A preferred silicone is the Biopor, which is biocompatible. However, other resilient materials, such as soft acrylic may also be applied. Generally, the soft ear mold should preferably be manufactured from a material having a hardness which is below 80 measured on the Shore durometer type A scale (see the standard ASTM D2240 for description of the test). This is often written as Shore 80A. Preferably, the hardness is below Shore 60A, and more preferably the hardness is in the range from Shore 20A to Shore 45A.

In order to solve the problem of the limited acoustic attenuation of the soft ear mold materials it has been proposed in the art to insert a sound tube of a highly acoustic attenuating material into the sound conduit of the soft ear mold. It has been proposed to use e.g. Polyvinyl Chloride (PVC) and Polyurethane (PUR) as sound tube material. These materials are relatively soft and it has therefore been suggested to insert the sound tube into the soft ear mold by:

- putting a hard mounting tool through the sound conduit of the ear mold such that the first end of the mounting tool is on the first side of the ear mold and the other end of the mounting tool is on the other side of the ear mold,
- fixing the sound tube onto a hard mounting tool,
- pulling the mounting tool, and hereby the sound tube, back through the sound conduit of the ear mold,
- removing the hard mounting tool from the sound tube, and
- trimming the ends of the sound tube to make them flush with the ear mold.

In order to keep the sound tube at the correct position inside the soft ear mold it has been suggested to achieve this by:

- providing a soft ear mold wherein the sound conduit is adapted to accommodate a bushing,
- putting a hard mounting tool through the sound conduit of the ear mold such that the first end of the mounting tool is on the first side of the ear mold (the side adapted to face outwards when inserted in an ear canal) and the other end of the mounting tool is on the other side of the ear mold, fixing a hard bushing to a first end of the sound tube, engaging the first end of the mounting tool with the second end of the sound tube, pulling the mounting tool, and hereby the sound tube and the bushing, back through the sound conduit of the ear mold until the bushing is seated correctly inside the ear mold, removing the hard mounting tool from the sound tube, and trimming the second end of the sound tube flush with the ear mold.

The soft ear molds may be further be disadvantageous in that traditional ear wax guards, such as disclosed in e.g. U.S. Pat. No. 9,795,562, cannot be used. The main reason for this is that the soft ear molds are not capable of accommodating an ear wax guard or an ear wax guard bushing in the same manner as a hard ear mold. It has therefore become common practice to use the soft ear molds without an ear wax guard. A consequence of this is that the sound tube has to be cleaned regularly which is more cumbersome than simply replacing an ear wax guard.

It is therefore a feature of the present invention to overcome at least these drawbacks and provide a soft custom ear mold that permits the use of an ear wax guard.

It is another feature of the current invention to provide a method for manufacturing a soft custom ear mold.

SUMMARY OF THE INVENTION

The invention, in a first aspect, provides a method for manufacturing a soft custom ear mold having an ear wax guard bushing, comprising the steps of providing an outer part of a soft custom ear mold with a through going conduit having holding means, providing an inner part of a soft custom ear mold comprising a first bushing, a sound tube and an ear wax guard bushing arranged such that the first bushing is fixed to the sound tube and a first end of the ear wax guard bushing is fixed to a first end of the sound tube, providing an elongated tool with an end adapted for engaging a second end of the ear wax guard bushing, putting the elongated tool through the soft custom ear mold conduit, fixing the elongated tool to the second end of the ear wax guard bushing; inserting the inner part into the ear mold conduit by pulling the elongated tool having said inner part attached, through the ear mold conduit until said first bushing is properly positioned in said holding means, and disengaging the elongated tool from the ear wax guard bushing.

This provides a manufacturing method that is simple to carry out and only requires the use of inexpensive tools.

The invention, in a second aspect, provides a soft custom ear mold comprising: an inner ear mold part that comprises a first bushing, a sound tube and an ear wax guard bushing, an outer ear mold part that is adapted to fit an individual ear canal and comprises a sound conduit having holding means adapted to engage the first bushing of said inner part, wherein said holding means defines the correct positioning of said inner part in the sound conduit of said outer part whereby a precise and stable positioning of the ear wax guard bushing in the soft custom ear mold is provided.

This provides a soft custom ear mold that permits the use of an ear wax guard that can be replaced by the hearing aid user in a simple manner.

Further advantageous features appear from the dependent claims.

Still other features of the present invention will become apparent to those skilled in the art from the following description wherein the invention will be explained in greater detail.

BRIEF DESCRIPTION OF THE DRAWINGS

By way of example, there is shown and described a preferred embodiment of this invention. As will be realized, the invention is capable of other different embodiments, and its several details are capable of modification in various, obvious aspects all without departing from the invention. Accordingly, the drawings and descriptions will be regarded as illustrative in nature and not as restrictive. In the drawings.

DETAILED DESCRIPTION

Figure 1:
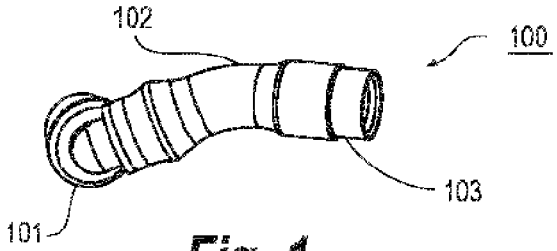
FIG. 1 illustrates a sound tube, a first bushing and a wax guard bushing in assembled form according to an embodiment of the invention.

Reference is now made to FIG. 1, which illustrates an inner part 100 of a soft custom ear mold. The inner part 100 comprises a first bushing 101, a sound tube 102 and a wax guard bushing 103. The first bushing 101 is fixed onto a first end of the sound tube 102, and the wax guard bushing 103 is fixed onto the second end of the sound tube 102. Both bushings are fixed onto the sound tube using a press-fit between the relatively hard bushings 101 and 103 and the comparatively soft sound tube 102.

The first bushing 101 is adapted such that it comprises a bend. This feature makes the first bushing 101 especially advantageous when inserted in the outer part of a soft ear mold since the sound conduit of the outer part of the soft custom ear mold may otherwise tend to collapse, in or around the bend, as may otherwise be imparted on insertion into an ear canal.

The sound conduit may comprise such a bend simply due to the shape of the ear canal or due to the placement of a receiver in the concha, in which case it may be required that the sound conduit bends from the plane of the concha and into the ear canal, e.g. as shown in WO-A1-2010040351.

The first bushing 101 is adapted such that it can be accommodated in a corresponding structure in the outer part 200 of the soft custom ear mold whereby the inner part 100 of the soft custom ear mold is fixed at the desired position inside the outer part 200 of the soft custom ear mold. Additionally the first bushing 101 comprises holding means adapted to detachably fix a receiver or a sound tube to that end of the first bushing 101 that is not fixed to the sound tube 102. Thus in the first case the first bushing is adapted for a receiver-in-the-ear (RITE) type hearing aid and in the latter case the first bushing is adapted for a traditional behind-the-ear (BTE) type hearing aid. The first case is further described below with reference to FIGS. 9-10 and the latter case is further described with reference to FIGS. 11-13.

As already discussed the sound tube 102 is preferably manufactured in materials such as Polyvinyl Chloride (PVC) or Polyurethane (PUR) that provide a suitable flexibility for insertion in the sound conduit of the outer part 200 of an ear mold while decreasing the acoustic leakage from the sound conduit.

The wax guard bushing 103 is adapted such that it can receive a replaceable ear wax guard 104. Such replaceable ear wax guards are well known within the art of hearing aids and are disclosed in e.g. U.S. Pat. No. 6,795,562 as already discussed above.

Thus it has to appreciated that the inner part 100 of the ear mold comprising the two bushings 101 and 103 and the sound tube 102 when inserted in the corresponding outer part 200 of the ear mold provide a soft custom ear mold 300 (see e.g. FIG. 10) that can accommodate the use of traditional replaceable ear wax guards 104, whereby the cleaning and maintenance of the soft custom ear mold 300 will become easier and the performance of the ear mold generally improve because the sound output opening of an ear mold having an ear wax guard will be less prone to clogging with ear wax.

Further it has to be appreciated that it is considerably easier to adapt the outer part 200 of the ear mold such that it can accommodate the first bushing 101 as opposed to adapting the outer part 200 of the ear mold to accommodate the wax guard bushing 103 because the first bushing 101 is larger and because the first bushing 101 is accommodated fully in the interior of the outer part 200 of the ear mold (as opposed to in an opening of the outer part 200 of the ear mold) which makes positioning and fixation of the inner part 100 in the outer part 200 of the soft custom ear mold less difficult to achieve. In the present context this presents a significant advantage because the soft custom ear molds are generally manufactured in-house by a hearing aid fitter using only simple manufacturing equipment. Furthermore the ear wax guard bushing 103 will be securely fixed to the inner part 100 of the soft custom ear mold and will therefore not tend to drop out from the soft custom ear mold.

In another embodiment the outer part 200 of the soft custom ear mold is manufactured using a negative of an ear canal impression as outer surface of the mold form and wherein the inner structure of the sound conduit is formed by using a mold insert to mold around. In a further embodiment the mold insert comprises a hard cylindrical mold insert part that may be inserted into a softer hollow sleeve having an outer structure corresponding to the desired inner structure of the sound conduit of the outer part of the soft custom ear mold. This type of mold insert allows the manufacture of a less pliable inner structure of the sound conduit, e.g. an inner structure adapted for snap fitting onto the first bushing whereby a more secure positioning and fixation of the inner part of the soft custom ear mold is provided. This can be achieved since the hard cylindrical insert part can be conveniently removed after molding independent of the inner structure of the sound conduit and after removal of this part the remaining hollow sleeve becomes very pliable and therefore easy to remove after molding even in case of a sound conduit with an inner structure having only limited pliability.

In variations according to the embodiment of FIG. 1 the bushings 101 and 103 may be fixed onto the sound tube 102 using at least one of the methods selected from a group comprising press-fitting, snap-fitting, gluing, welding and two-component molding. Especially press-fitting and gluing can be combined.

Figure 2:
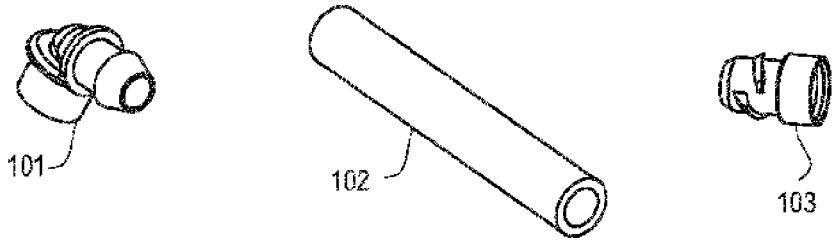
FIG. 2 illustrates the sound tube, the first bushing and the wax guard bushing of FIG. 1 in unassembled form.

Reference is now made to FIG. 2, which illustrates the first bushing 101, the wax guard bushing 103 and the sound tube 102 as separated components prior to being assembled into the inner part 100 of the soft custom ear mold.

Figure 3:
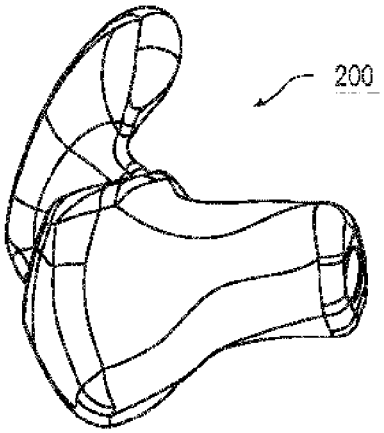
FIG. 3 illustrates an outer part of a soft custom ear mold according to an embodiment of the invention.

Reference is also made to FIG. 3, which illustrates the outer part 200 of a soft custom ear mold.

Reference is now made to the FIGS. 4-8, which illustrate a tool for mounting the inner part 100 of the soft custom ear mold in the outer part 200 of the soft custom ear mold 300 and corresponding steps of a method for mounting said inner part 100 in said outer part 200.

Figure 4:
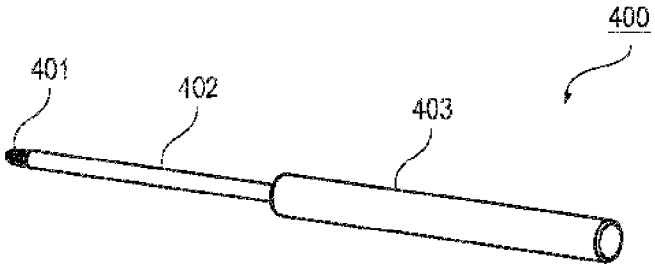
FIG. 4 illustrates an elongated tool adapted for engaging a wax guard bushing according to an embodiment of the invention.

Reference is first made to FIG. 4, which illustrates an elongated tool 400 with a pointed thread 401 adapted such that the tool 400 when engaging the inner surface of the wax guard bushing 103 enables the wax guard bushing 103 to be pulled through the outer part of the soft custom ear mold 200. The tool comprises a forward part 402 with a narrow diameter adapted to fit inside a conduit and with a length sufficient to extend through the conduit to protrude at the other end. Further the tool comprises a rearward part 403 which is thicker and is adapted to provide a grip for manipulation.

Figure 5:
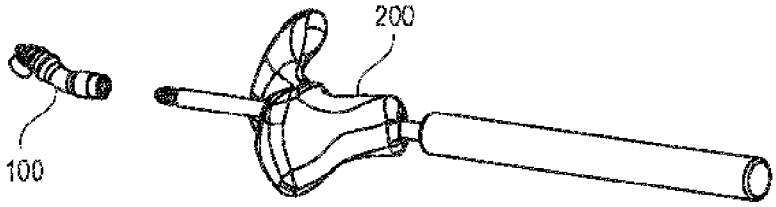
FIG. 5 illustrates a first stage in a method for manufacturing a soft custom ear mold according to an embodiment of the invention.

Reference is now made to FIG. 5, which illustrates a first step in said method wherein said pointed thread 401 and forward part 402 of the tool 400 has been put through said outer part 200.

Figure 6:
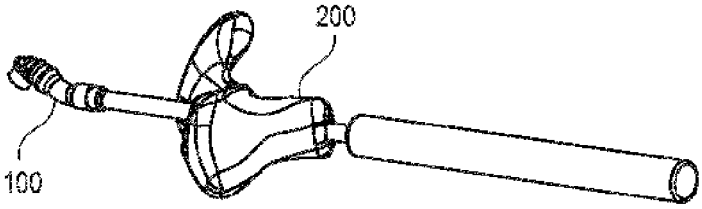
FIG. 6 illustrates a second stage in a method for manufacturing a soft custom ear mold according to an embodiment of the invention.

Reference is then made to FIG. 6 wherein said tool 400 has engaged said inner part 100.

Figure 7:
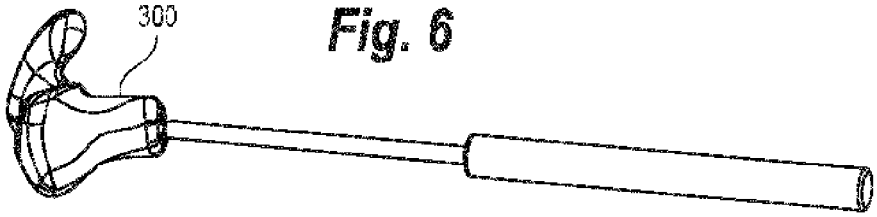
FIG. 7 illustrates a third stage in a method for manufacturing a soft custom ear mold according to an embodiment of the invention.

Reference is then made to FIG. 7 wherein said elongated tool 400 with said inner part 100 attached has been pulled back through said outer part 200 until the first bushing 101 is seated in the corresponding structure (not visible in the drawing) in said outer part, whereby the soft custom ear mold 300 is completed. Subsequently the elongated tool 400 is disengaged from the wax guard bushing 103 by twisting the elongated tool 400 in the opposite direction of the rotation used for the initial engagement. The soft custom ear mold 300 is hereby provided with a wax guard bushing 103 that allows traditional replaceable wax guards to be used.

Figure 8:
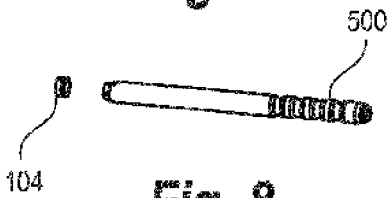
FIG. 8 illustrates a wax guard and a wax guard insertion and extraction tool according to an embodiment of the invention.

Finally reference is made to FIG. 8, which illustrates a traditional wax guard insertion and extraction tool 500 and a corresponding wax guard 104. Further details may be found in U.S. Pat. No. 6,795,562.

Figure 9:
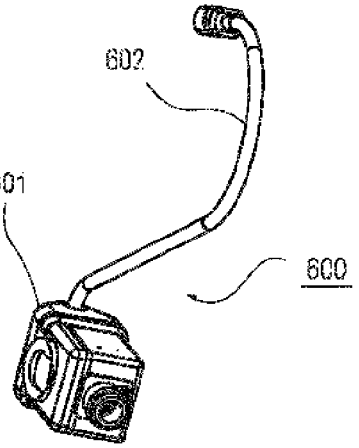
FIG. 9 illustrates a receiver module adapted for insertion in a soft custom ear mold according to an embodiment of the invention.
Figure 10:
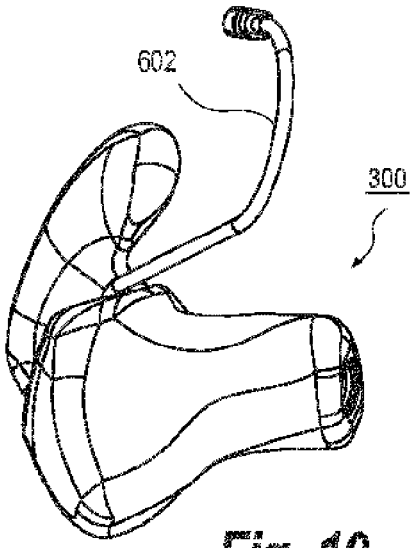
FIG. 10 illustrates the soft custom ear mold according to an embodiment of the invention with the receiver module of FIG. 9 inserted.

Reference is now made to FIGS. 9-10, which illustrate insertion of a receiver module 600 in a soft custom ear mold 300 according to an embodiment of the invention.

Reference is first made to FIG. 9, which illustrates the receiver module 600 that comprises the receiver housing 601 and a corresponding electrical conductor 602 for connection to the external part of the RITE hearing aid. The receiver housing 601 comprises holding means adapted for engagement with a first bushing 101 of the inner part 100 of the soft custom ear mold 300.

Reference is finally made to FIG. 10, which illustrates the soft custom ear mold 300 with the receiver module 600 inserted.

Figure 11:
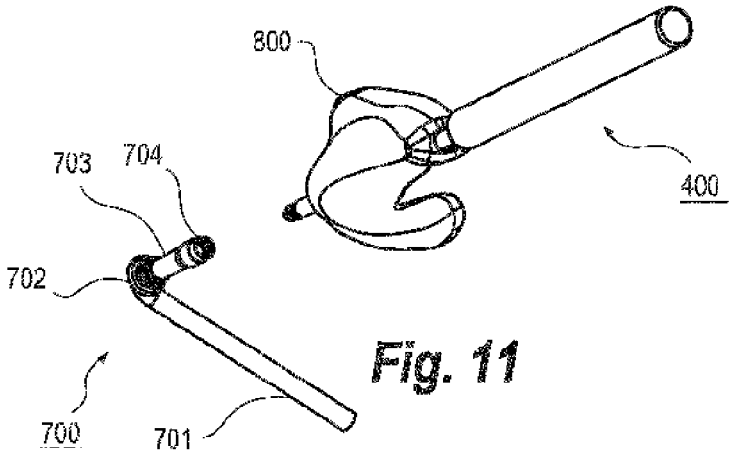
FIG. 11 illustrates a first stage in a method for manufacturing a soft custom ear mold according to an embodiment of the invention.
Figure 12:
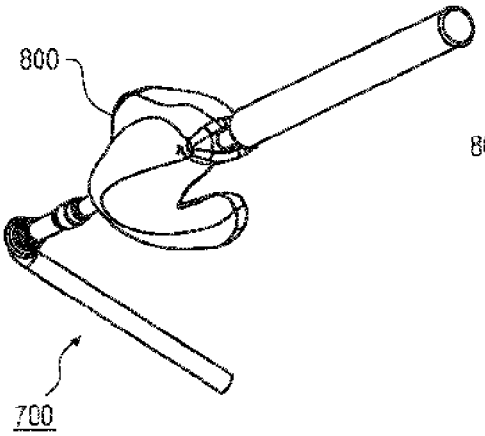
FIG. 12 illustrates a second stage in a method for manufacturing a soft custom ear mold according to an embodiment of the invention.
Figure 13:
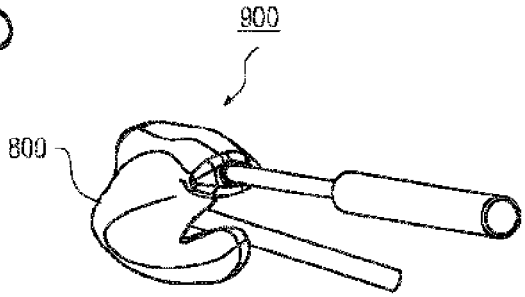
FIG. 13 illustrates a third stage in a method for manufacturing a soft custom ear mold according to an embodiment of the invention.

Reference is now made to FIGS. 11-13, which illustrate insertion of an inner part 700 in an outer part 800 of a soft custom ear mold according to an embodiment of the invention.

Reference is first made to FIG. 11, which illustrates the inner part 700 of the soft custom ear mold, the outer part 800 of the soft custom ear mold and an elongated tool 400.

The inner part 700 comprises an external sound tube part 701, a first bushing 702, an internal sound tube part 703 and a wax guard bushing 103, 704, wherein the first bushing 702 is adapted such that a precise and firm positioning of the sound tube assembly 700 inside the outer part 800 is obtained when the first bushing 702 engages corresponding holding means formed at the inner surface of the sound conduit of the outer part 800 of the soft custom ear mold. Further FIG. 11 illustrates a first step in the method for mounting the inner part 700 in the outer part 800 of the custom ear mold, wherein said elongated tool 400 has been put through said outer part 800.

Reference is then made to FIG. 12 wherein said elongated tool 400 has engaged the wax guard bushing 103, 704 of said inner part 700.

Reference is then made to FIG. 13 wherein said elongated tool 400 with said inner part 700 attached has been pulled back through said outer part 800 until the first bushing 702 is accommodated in the corresponding structure (not visible in the drawing) in said outer part 800, whereby the soft custom ear mold 900 is completed. Subsequently the elongated tool 400 will be disengaged from the wax guard bushing 103, 704 by twisting the elongated tool 400 in the opposite direction of the rotation used for the initial engagement. The soft custom ear mold 900 is hereby provided with a wax guard bushing 103 that allows traditional replaceable wax guards to be used.

According to the embodiment of FIG. 11, the internal 703 and external 701 parts of the sound tube is one single tube and the first bushing 702 is fixed to an intermediate part of the sound tube. In variations of the sound tube according to FIG. 11, the internal 703 and external 701 parts of the sound tube are two separate parts and the two ends of the first bushing are connected to the corresponding ends of the two sound tubes.

Other modifications and variations of the structures and procedures will be evident to those skilled in the art.

We claim:

1. A method for manufacturing a soft custom ear mold having an ear wax guard bushing, comprising the steps of:

providing an outer part of a soft custom ear mold with a through going conduit having holding means, providing an inner part of a soft custom ear mold comprising a first bushing, a sound tube and an ear wax guard bushing arranged such that the first bushing is fixed to the sound tube and a first end of the ear wax guard bushing is fixed to a first end of the sound tube, providing an elongated tool with an end adapted for engaging a second end of the ear wax guard bushing, putting the elongated tool through the soft custom ear mold conduit, fixing the elongated tool to the second end of the ear wax guard bushing;

inserting the inner part into the ear mold conduit by pulling the elongated tool having said inner part attached, through the ear mold conduit until said first bushing is properly positioned in said holding means, and disengaging the elongated tool from the ear wax guard bushing.

2. The method according to claim 1, wherein a first end of the first bushing is fixed to a second end of the sound tube of said inner part.

3. The method according to claim 1, wherein the first bushing is fixed to a center part of the sound tube of said inner part.

4. A soft custom ear mold comprising:

an inner ear mold part that comprises a first bushing, a sound tube and an ear wax guard bushing, an outer ear mold part of a soft material that is configured to fit an individual ear canal and comprises a sound conduit having a holding structure configured to engage the first bushing of said inner part, wherein said holding structure defines the correct positioning of said inner part in the sound conduit of said outer part whereby a desired positioning of the ear wax guard bushing in the soft custom ear mold is provided.

5. The soft custom ear mold according to claim 4, wherein a first end of the first bushing is fixed to a second end of the sound tube.

6. The soft custom ear mold according to claim 5, wherein a second end of the first bushing is adapted to engage a receiver module.

7. The soft custom ear mold according to claim 5, wherein the second end of the first bushing is adapted to engage a first end of a second sound tube and wherein the second end of the second sound tube is adapted to be connected to a behind-the-ear hearing aid part.

8. The soft custom ear mold according to claim 4, wherein the first bushing is fixed to a center part of the sound tube such that the second end of the sound tube is adapted to be connected to a behind-the-ear hearing aid part.

9. The soft custom ear mold according to claim 4, wherein a first end of the first bushing is fixed to a second end of the sound tube.

10. The soft custom ear mold according to claim 4, wherein said wax guard bushing is configured to receive a replaceable ear wax guard.

11. The soft custom ear mold according to claim 4, wherein the first bushing is fixed onto a first end of the sound tube and the wax guard bushing fixed onto a second end of the sound tube.

12. The soft custom ear mold according to claim 11, wherein the first bushing, the wax guard bushing and the sound tube are separate components prior to being assembled into the inner ear mold part.

13. The soft custom ear mold according to claim 12, wherein said wax guard bushing is configured to receive a replaceable ear wax guard.

14. A hearing aid comprising a soft custom ear mold comprising an inner ear mold part that comprises a first bushing, a sound tube and an ear wax guard bushing, an outer ear mold part that is adapted to fit an individual ear canal and comprises a sound conduit having holding means adapted to engage the first bushing of said inner part, wherein said holding means defines the correct positioning of said inner part in the sound conduit of said outer part whereby a precise and stable positioning of the ear wax guard bushing in the soft custom ear mold is provided.

15. A soft custom ear mold comprising:

an inner ear mold part that comprises a first bushing, a sound tube and an ear wax guard bushing configured to hold a replaceable ear wax guard, an outer ear mold part of a soft material that is configured to fit an individual ear canal and comprises a sound conduit having a holding structure configured to engage the first bushing of said inner part, wherein said holding structure defines the correct positioning of said inner part in relation to the sound conduit of said outer part.

16. The soft custom ear mold according to claim 15, wherein the first bushing is fixed onto a first end of the sound tube and the wax guard bushing fixed onto a second end of the sound tube.

17. The soft custom ear mold according to claim 16, wherein the first bushing, the wax guard bushing and the sound tube are separate components prior to being assembled into the inner ear mold part.

* * * * *